US007334917B2

(12) United States Patent
Laski

(10) Patent No.: US 7,334,917 B2
(45) Date of Patent: Feb. 26, 2008

(54) ILLUMINATION DEVICE

(75) Inventor: Joseph John Laski, Stoneham, MA (US)

(73) Assignee: Osram Opto Semiconductors GmbH, Regensburg (DE)

( * ) Notice: Subject to any disclaimer, the term of this patent is extended or adjusted under 35 U.S.C. 154(b) by 0 days.

(21) Appl. No.: 11/238,247

(22) Filed: Sep. 29, 2005

(65) Prior Publication Data

US 2006/0082333 A1 Apr. 20, 2006

(30) Foreign Application Priority Data

Sep. 30, 2004 (DE) ..... 10 2004 047 766

(51) Int. Cl.
*F21V 9/00* (2006.01)

(52) U.S. Cl. ..... 362/231; 362/251; 362/252; 315/246; 315/287

(58) Field of Classification Search ..... 362/249, 362/252, 230, 231, 800, 293, 251; 315/185 R, 315/193, 246, 287, 307, DIG. 4, 308
See application file for complete search history.

(56) References Cited

U.S. PATENT DOCUMENTS 5,350,977 A * 9/1994 Hamamoto et al. ..... 315/291
5,803,579 A * 9/1998 Turnbull et al. ..... 362/516
6,132,072 A * 10/2000 Turnbull et al. ..... 362/494
6,213,615 B1 * 4/2001 Siitari ..... 362/600
6,234,645 B1 * 5/2001 Borner et al. ..... 362/231
6,488,390 B1 * 12/2002 Lebens et al. ..... 362/231
6,523,976 B1 * 2/2003 Turnbull et al. ..... 362/231
6,683,423 B2 1/2004 Cunningham
6,930,452 B2 * 8/2005 De Krijger et al. ..... 315/192
6,955,355 B2 * 10/2005 Denoual ..... 273/290
7,014,336 B1 * 3/2006 Ducharme et al. ..... 362/231
7,106,378 B2 * 9/2006 Kawakami ..... 348/371
7,145,125 B2 * 12/2006 May et al. ..... 250/228
2004/0037079 A1 2/2004 Luk
2004/0105261 A1 6/2004 Ducharme et al.
2005/0237733 A1 * 10/2005 Laski et al. ..... 362/147
2005/0276053 A1 * 12/2005 Nortrup et al. ..... 362/294

FOREIGN PATENT DOCUMENTS

DE 102 39 449 A1 8/2003
WO WO 03/105540 A2 12/2003

* cited by examiner

*Primary Examiner*—Thomas M. Sember
(74) *Attorney, Agent, or Firm*—Cohen Pontani Lieberman & Pavane LLP

(57) ABSTRACT

An illumination device comprising at least four luminous units (1, 2), the light emitted by at least two of the four luminous units (1, 2) being suitable for being mixed to form white light. Moreover, an apparatus (3) for dimming at least one of the four luminous units (1, 2) is provided. White light having a desired color temperature (CCT) and a high color rendering index can be generated by means of the illumination device.

9 Claims, 5 Drawing Sheets

| CCT | B | Y | R | G |
|---|---|---|---|---|
| 2500 K | 27.93% | 83.70% | 86.40% | 100% |
| 2800 K | 34.01% | 72.10% | 75.10% | 100% |
| 3000 K | 37.98% | 67.50% | 70.50% | 100% |
| 3500 K | 48.90% | 64.70% | 58.70% | 100% |
| 4100 K | 59.30% | 59.80% | 51.70% | 100% |
| 5000 K | 71.20% | 51.60% | 47.60% | 100% |
| 5500 K | 79.40% | 53.20% | 43.60% | 100% |
| 6500 K | 100% | 47.70% | 43.20% | 100% |

ILLUMINATION DEVICE

RELATED APPLICATION

This patent application claims the priority of German patent application 10 2004 047 766.3 filed Sep. 30, 2004, the disclosure content of which is hereby incorporated by reference.

FIELD OF THE INVENTION

The invention relates to an illumination device.

SUMMARY OF THE INVENTION

It is an object of the present invention to provide an illumination device which can be used in a particularly diverse manner.

This and other objects are attained in accordance with one aspect of the present invention directed to an illumination device having at least four luminous units. The light emitted by at least two of the four luminous units is suitable for being mixed to form white light. The light from at least two of the luminous units is mixed by means of additive color mixing to form white light. At least one of the luminous units is dimmable. An apparatus suitable for dimming at least one of the four luminous units is preferably provided for this purpose.

That is to say that the brightness of the light emitted by the luminous unit can be varied within specific limits, for example with the aid of the apparatus. The brightness of the light emitted by the luminous unit may be able to be set for example between zero, that is to say the luminous unit emits no light, and a maximum brightness.

Preferably, at least two of the four luminous units are dimmable; particularly preferably, at least three of the four luminous units are dimmable. Moreover, it is also possible for all the luminous units of the illumination device to be dimmable.

In this case, the illumination device makes use of the idea that properties of the light emitted by the illumination device, such as the color locus (also known as chromaticity coordinate), the color temperature or the color rendering index of the light emitted by the illumination device, can be set in a defined manner by means of varying the brightness of at least one of the luminous units.

If, by way of example, two of the luminous units of the illumination device are suitable for emitting light of different colors, then it is possible, by increasing the brightness of one of the colors, to increase the proportion of said color in the mixed light of the illumination unit. In this way, therefore, it is possible to shift the color locus of the mixed-color light in the direction of the color whose brightness has been increased. Furthermore, it is thereby possible to alter the color temperature and also the color rendering index of the illumination device.

According to one embodiment of the illumination device, at least one luminous unit has a component suitable for generating substantially monochromatic light. That is to say that the light emitted by the component has an intensity peak at a central wavelength having a full width at half maximum of a few nanometers. Preferably, at least one of the luminous units has at least one of the following radiation-emitting components: light-emitting diode, organic light-emitting diode, laser, electroluminescent film. Preferably, each of the luminous units has at least one of said components. By way of example, each luminous unit may have at least one light-emitting diode or at least one laser diode.

In one embodiment of the illumination device, the apparatus for dimming is suitable for generating a pulse-width-modulated signal.

The pulse-width-modulated signal is an electrical rectangular signal, by way of example. If the pulse-width-modulated signal is present for instance at one of the luminous units, then it is possible, for example, for the luminous unit to be operated with a predeterminable current $I_1$ greater than zero for a predeterminable first time period $t_1$. By way of example, no current then flows through the luminous unit for a predeterminable second time period $t_2$. If the frequency of the pulse-width-modulated signal $1/(t_1+t_2)$ is high enough here, preferably greater than or equal to 100 hertz, then the human observer cannot perceive any flicker of the light emitted by the luminous unit. By way of example, by increasing the first time period $t_1$, it is possible, with the frequency $1/(t_1+t_2)$ remaining the same and with the current $I_1$ remaining the same, for the brightness of the light of the luminous unit driven by the pulse width modulation circuit to be increased for the human observer.

Preferably, the apparatus is suitable for generating pulse-width-modulated signals that are independent for operating at least three of the luminous units. That is to say that at least three of the luminous units can be dimmed independently of one another by means of the apparatus. Particularly preferably, the apparatus is suitable for generating pulse-width-modulated signals for all the luminous units.

In accordance with an embodiment of the illumination device, the illumination device has a control apparatus for driving the apparatus for dimming, which is suitable for the defined setting of a correlated color temperature of the light emitted by the illumination device. In this case, correlated color temperature is understood to mean, for example, the temperature of a black body radiator whose perceived color, and at specific observation conditions, for example given identical brightness, is the most similar to the light emitted by the illumination device.

The control apparatus makes it possible, for example, to set the first and second time periods for the generation of pulse-width-modulated signals for at least one luminous unit. By way of example, the brightness of the light generated by said luminous unit can thus be set in a defined manner. By varying the brightness of light from the luminous units, it is possible to change, in a defined manner, the proportion of one or more colors in the white light generated by the illumination unit. This enables a controlled setting of the correlated color temperature of the illumination unit to a desired value.

By way of example, it is possible that the control apparatus can be used to select from a specific number of correlated color temperatures. However, it is also possible for the control apparatus to permit the correlated color temperature to be set substantially freely within a specific temperature range. In this case, substantially freely means that the correlated color temperature can be altered in small temperature intervals of, for example, less than or equal to one kelvin.

If, by way of example, the brightness of a luminous unit of a specific color changes during the operation of the illumination device, then it is possible that the color temperature of the illumination device can be reset to a predetermined value again by means of the control apparatus. If, when using light-emitting diodes as light-generating elements, it is known for example that the brightness of blue light-emitting diodes decreases more rapidly during operation than the brightness of the light-emitting diodes of other colors and the color temperature of the illumination device thereby changes—for example decreases—, then it is possible, by means of the control apparatus, to readjust the color temperature to a predetermined value again after a specific, predeterminable operating duration.

In another embodiment of the illumination device, it is possible for at least the light emitted by one of the luminous units to be suitable for increasing the color rendering index of the illumination device.

The color rendering index (CRI) is a measurement quantity specifying how well colors are rendered under specific illumination conditions compared with a reference light source such as, for example, an incandescent bulb or daylight. On a scale from 0 to 100, a color rendering index of 100 means that all colors of a test object, upon illumination with the light source to be assessed, appear exactly the same way as upon illumination with a reference light source.

If the illumination device generates white light for example by mixing light of two complementary colors such as blue and yellow, then the illumination device may additionally contain at least one luminous unit suitable for generating light of a different color, for example green or red light. The color rendering index of the white light generated by the illumination device is thereby increased. The spectrum of the light emitted by the illumination device then corresponds significantly better to the spectrum of a black body radiator of a given color temperature. In the same way, however, it is possible to increase the color rendering index if the illumination device generates white light by means of mixing three colors and light of at least one further color is additionally admixed.

By way of example, a color rendering index of greater than 70, preferably greater than 85, particularly preferably greater than 95, can be achieved by the illumination device in this way for instance when using light-emitting diodes as light-generating elements, at a predetermined color temperature.

In accordance with another embodiment of the illumination device, at least one luminous unit of the illumination device is suitable for emitting light having a central wavelength of between 455 and 485 nanometers (blue light), at least one luminous unit is suitable for emitting light having a central wavelength of between 512 and 538 nanometers (green light), at least one luminous unit is suitable for emitting light having a central wavelength of between 580 and 594 nanometers (yellow light) and at least one luminous unit is suitable for emitting light having a central wavelength of between 608 and 626 nanometers (red light). In this case, central wavelength is to be understood to mean the maximum of the intensity spectrum of the respective luminous unit.

Furthermore, it is possible for the illumination device additionally to have luminous units having other central wavelengths. In this case, the color rendering index of the illumination device can advantageously be increased further for a given correlated color temperature.

In accordance with another embodiment of the illumination device, the illumination device has at least one light-emitting diode module containing at least one light-emitting diode suitable for generating light in the red spectral range, at least one light-emitting diode suitable for generating light in the green spectral range, and at least one light-emitting diode suitable for generating light in the blue spectral range.

Furthermore, the illumination device preferably has a light-emitting diode module containing at least one light-emitting diode suitable for generating light in the yellow spectral range.

In this case, the four luminous units of the illumination device are thus provided by red, green, blue and yellow light-emitting diodes of the light-emitting diode modules. In this case, light-emitting diode module is to be understood to mean a prefabricated arrangement of light-emitting diodes. The light-emitting diodes of each color can preferably be contact-connected jointly. By way of example, a module has at least ten light-emitting diodes of each color present in the module, and the ten identically colored light-emitting diodes can in each case be contact-connected jointly. By way of example, the identically colored light-emitting diodes can be connected in series with one another.

The illumination device additionally has an apparatus suitable for generating pulse-width-modulated signals for driving at least one portion of the light-emitting diodes. By way of example, the apparatus may be suitable for jointly driving the light-emitting diodes of a specific color. In this way, the light of this color can be dimmed by means of the apparatus.

Preferably, the apparatus is suitable for dimming the light of at least three colors. The colors can be dimmed independently of one another in this case.

Furthermore, the illumination device is preferably provided with a control apparatus, by means of which a multiplicity of predefined correlated color temperatures of the light emitted by the illumination device can be set. This means, for example, that the control apparatus makes it possible for a user to choose between a multiplicity of color temperatures.

In another embodiment of the illumination device, the user may in this case choose between the following color temperatures: 6500 kelvins, 5500 kelvins, 5000 kelvins, 4100 kelvins, 3500 kelvins, 3000 kelvins, 2800 kelvins, and 2500 kelvins.

DETAILED DESCRIPTION OF THE DRAWINGS

In the exemplary embodiments and Figures, identical or identically acting constituent parts are in each case provided with the same reference symbols. The constituent parts illustrated and also the relative sizes of the constituent parts among one another are not to be regarded as true to scale. Rather, some details of the Figures are illustrated with their size exaggerated in order to afford a better understanding.

Figure 1:
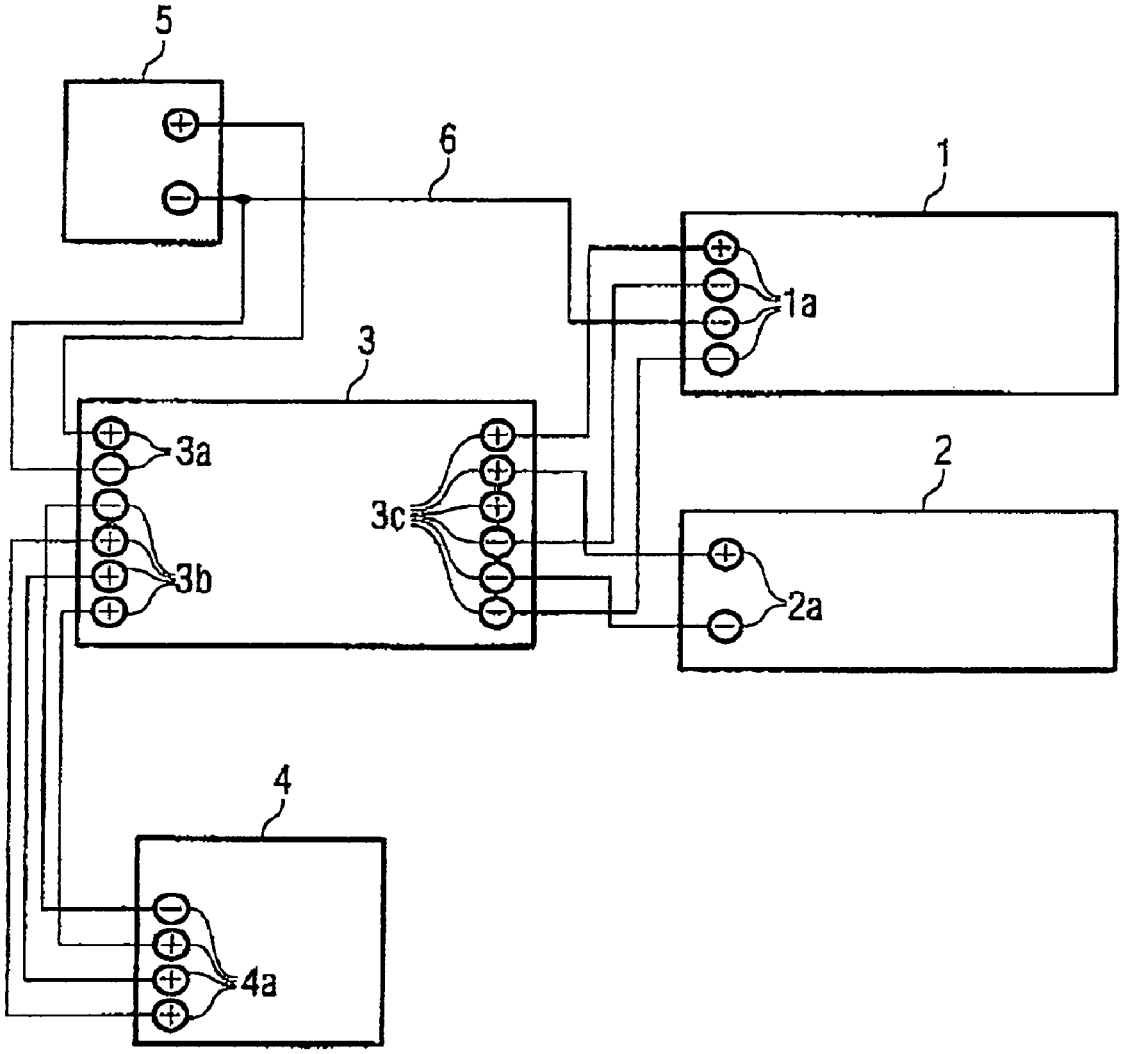
FIG. 1 shows by way of example a circuit diagram of a first exemplary embodiment of the illumination device described here.

FIG. 1 shows by way of example a circuit diagram of a first exemplary embodiment of the illumination device described here. An RGB light-emitting diode module 1 and a light-emitting diode module 2 serve as luminous units here.

The RGB light-emitting diode module 1 has for example a multiplicity of red, green and blue light-emitting diodes. In this case, the light-emitting diodes of the individual colors can be operated jointly in each case by means of the current supply inputs 1*a*. The light-emitting diodes of different colors can be energized independently of one another. The light-emitting diode module 1 may be for example a Colormix RGB module from the company Osram, such as the module OS-LM 10L-RGB, for example.

The light-emitting diode module 2 contains for example light-emitting diodes suitable for emitting light in the yellow spectral range. All the light-emitting diodes of the light-emitting diode module 2 can be energized simultaneously by means of the current supply input 2*a*. The light-emitting diode module 2 is for example the OS-LM 10A-Y1 module from the company Osram.

By way of example, the light-emitting diodes of the light-emitting diode module 2 and two colors of the light-emitting diode module 1 are driven by means of pulse-width-modulated signals by the pulse width modulation circuit 3 via the signal outputs 3*c*. The individual colors can be dimmed independently of one another in this case. One color of the light-emitting diode module 1 may be connected directly to a current supply 5, for example. This color is not dimmed in that case, rather it emits light for example with maximum brightness. The brightness of this color may in this case serve as reference brightness for the other colors. By way of example, the light-emitting diodes of the light-emitting diode module 1 that emit green light are connected directly to the current supply 5 via the connection 6. However, it is also possible for the light-emitting diodes of the light-emitting diode module 2 to be directly connected to the current supply and for all colors of the light-emitting diode module 1 to be dimmable by means of the pulse width modulation circuit 3. It is furthermore possible for the light-emitting diodes of one color to be supplied by means of a separate current source (not shown).

The pulse width modulation circuit 3 is connected to the current supply 5 by means of the current input 3*a*. By way of example, it is provided by the three-channel dimmer OT-RGB 3-CH DIM from the company Osram. The channels of the pulse width modulation circuit 3 can be driven independently of one another by means of the control input 3*b* of the pulse width modulation circuit 3.

By means of the control apparatus 4, the pulse width modulation circuit 3 is driven by means of the control outputs 4*a* of the control apparatus 4. By way of example, the duty ratio, that is to say the ratio of first time period $t_1$, in which a current $I_1$ not equal to zero flows, to the sum of first and second time periods ($t_1$+$t_2$), can thereby be set independently for each channel. As a result, it is possible to set the brightness of the light for three of the four colors of the light-emitting diode modules 1, 2. Depending on the duty ratios of the pulse-width-modulated signals with which the light-emitting diodes of the light-emitting diode modules 1, 2 are driven, a specific color temperature CCT of the light generated by the illumination device can be set in a defined manner in this way.

Figure 2:
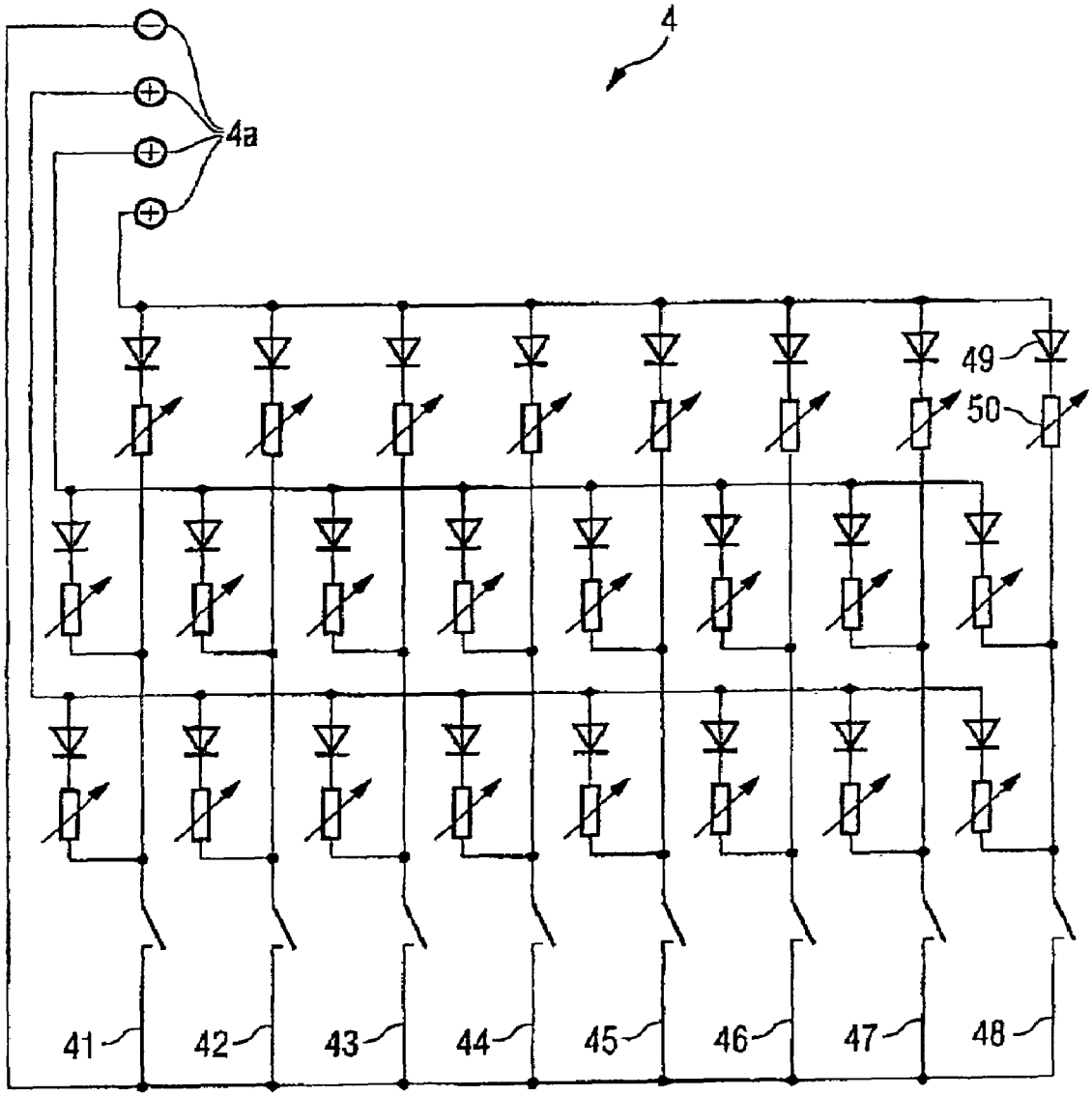
FIG. 2 shows by way of example a circuit diagram of an exemplary embodiment of the control apparatus described here.

FIG. 2 shows by way of example a circuit diagram of an exemplary embodiment of the control apparatus 4. By means of the switches 41 to 48, it is possible to set eight different color temperatures CCT of the illumination device. For this purpose, one of the switches 41 to 48 is closed and the remaining switches remain open. For the driving of the three channels of the pulse width modulation circuit 3, the control apparatus has for this purpose a network of three times eight diodes 49 and three times eight potentiometers 50. In this case, the potentiometers are each set to specific resistance values, so that, as a result of one of the switches 41 to 48 being closed, white light having the desired color temperature CCT is generated by the illumination device.

FIGS. 3*a* to 3*h* show resulting spectra in this respect of the light generated by the illumination device. The light-emitting diodes of the light-emitting diode module 1 that are suitable for generating green light are in this case connected directly to the current source 5. The intensity of the green light may therefore serve as a reference hereinafter.

Figure 3A:
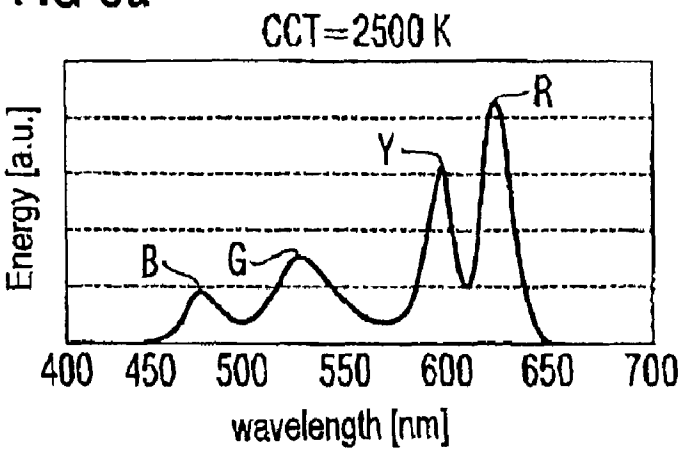
FIGS. 3*a* to 3*h* show by way of example spectra of light generated by means of the illumination device.

FIG. 3*a* shows by way of example a spectrum for a correlated color temperature CCT of 2500 kelvins. In this case, the lines B, G, Y, and R show the relative measured intensity of the blue, green, yellow and red light. In order that a spectrum in accordance with FIG. 3*a* is generated by the illumination device, it is necessary, for example, for the switch 48 of the control apparatus 4 to be closed. All other switches of the control apparatus remain open.

Figure 3B:
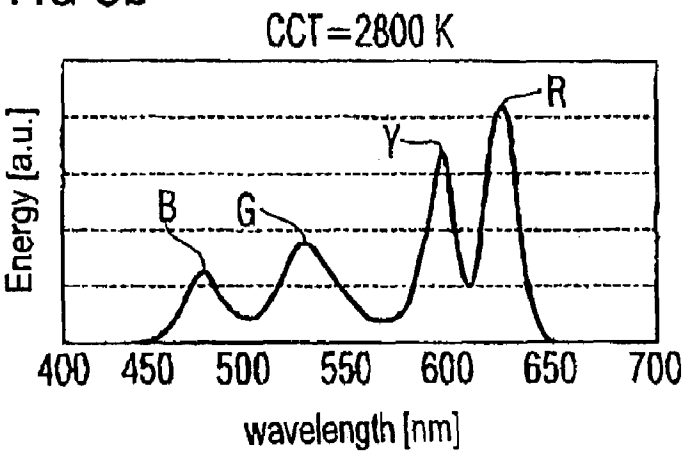

FIG. 3*b* shows a spectrum for a correlated color temperature CCT of 2800 kelvins; switch 47 of the control apparatus 4 is then closed.

Figure 3C:
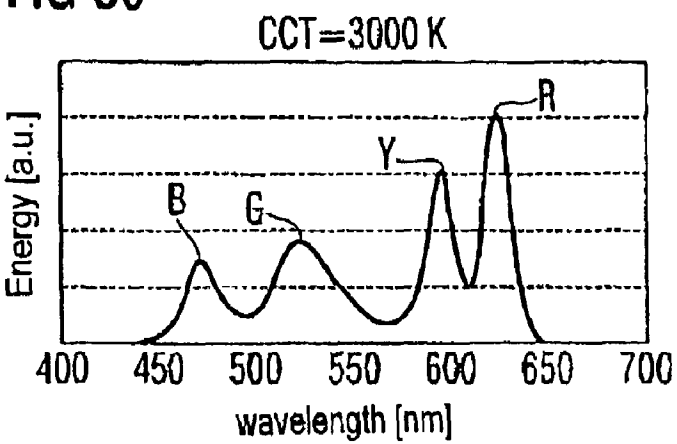

FIG. 3*c* shows a spectrum for a correlated color temperature CCT of 3000 kelvins. In order to obtain this spectrum, switch 46 must be closed.

Figure 3D:
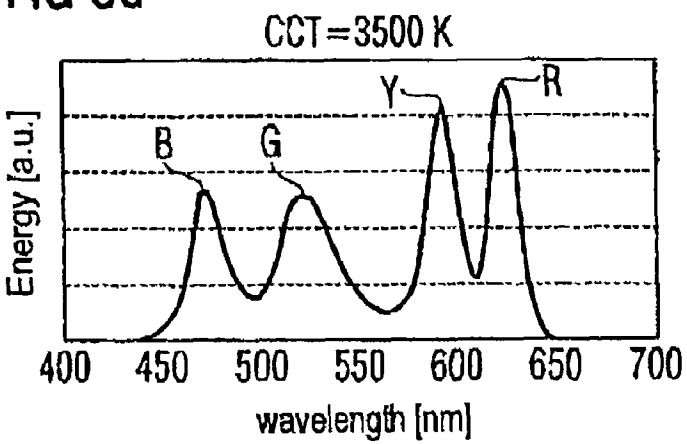

FIG. 3*d* shows a spectrum for a correlated color temperature CCT of 3500 kelvins, switch 45 of the control apparatus 4 being closed.

Figure 3E:
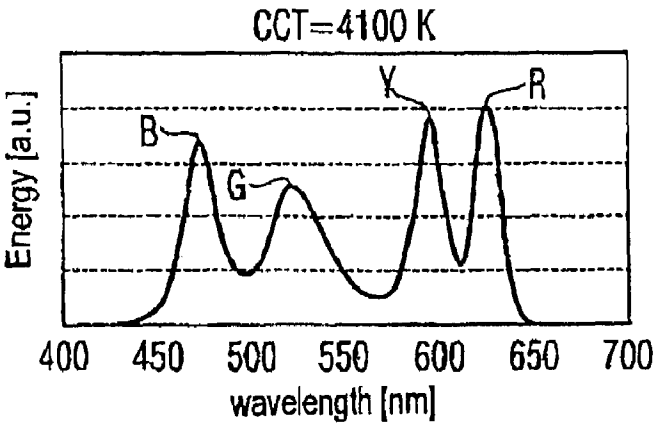

FIG. 3*e* shows a spectrum for a correlated color temperature CCT of 4100 kelvins; switch 44 is then closed.

Figure 3F:
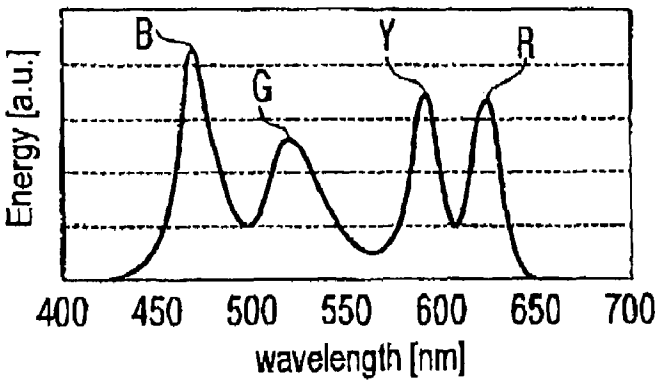

FIG. 3*f* shows a spectrum for the correlated color temperature CCT of 5000 kelvins with switch 43 closed.

Figure 3G:
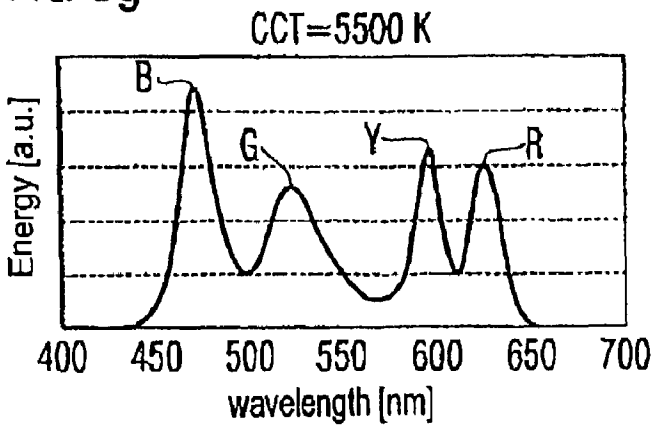

FIG. 3*g* shows a spectrum at a correlated color temperature CCT of 5500 kelvins and with switch 42 closed.

Figure 3H:
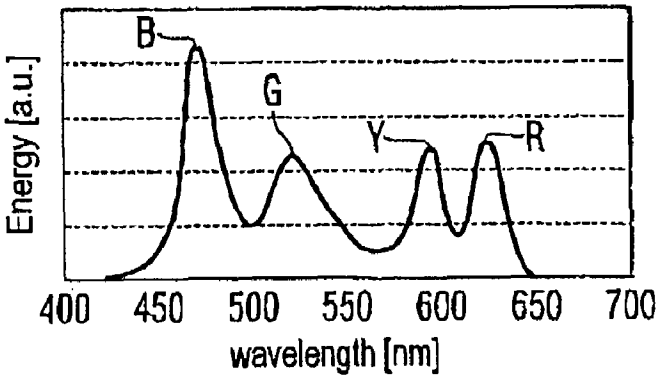

FIG. 3*h*, finally, shows a spectrum for a correlated color temperature CCT of 6500 kelvins and with switch 41 closed.

Figures 4, 5:
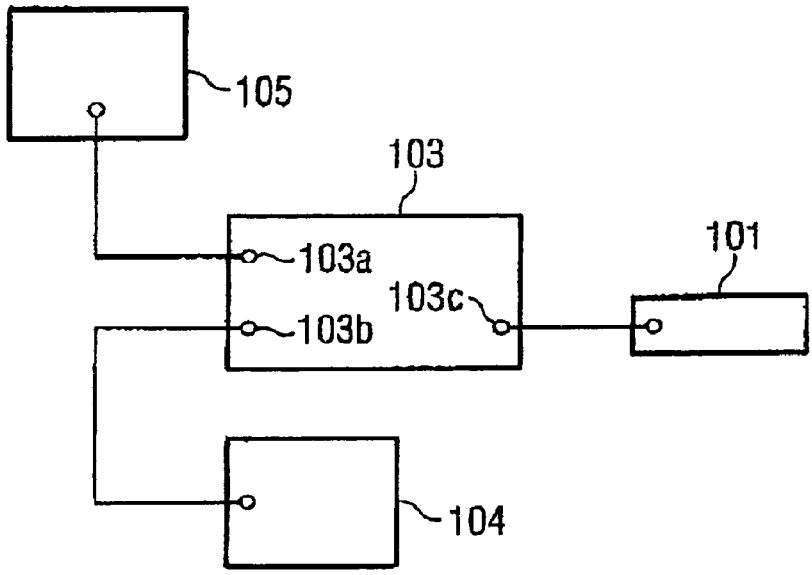
FIG. 4 shows a table with measured voltages.
FIG. 5 shows by way of example a circuit diagram of a second exemplary embodiment of the illumination device described here.

FIG. 4 shows a table with measured voltage values for various correlated color temperatures CCT. That is to say that these voltages are then present for example at the control inputs 3*b* of the pulse width modulation circuit 3 of FIG. 1.

The highest voltage value that may be present in this case at a control input 3*b* for the light-emitting diodes of a specific color is normalized to 100% here and corresponds to 10 V, for example, in the exemplary embodiment of FIG. 1. Given a voltage value of 100%, the light-emitting diodes of the color associated with the control input then emit light with maximum intensity. A voltage value of 0% corresponds to switched-off light-emitting diodes, that is to say that no voltage is present at the control input 3*b* of the color. Since, in the exemplary embodiment of FIG. 1, the green light-emitting diodes of the light-emitting diode module 1 are directly connected to the current supply and these light-emitting diodes therefore emit light with maximum intensity, their voltage value is set at 100% in the table of FIG. 4.

If the intention, therefore, is to set a specific color temperature CCT, then the potentiometers 50 of the control apparatus 4 are set such that the voltages listed in the table of FIG. 4 are made available at control outputs 4*a* of the control apparatus 4.

FIG. 5 shows by way of example a circuit diagram of a second exemplary embodiment of the illumination device described here. The luminous units of the illumination device are combined in the luminous module 101 here. It contains for example light-emitting diodes suitable for generating light in the red, green, blue and yellow spectral ranges.

The individual colors here can be dimmed independently of one another in each case by means of the pulse width modulation circuit 103. For this purpose, the pulse width modulation circuit 103 is a dimmer having at least four channels which can be addressed independently of one another and which are addressed by means of the control apparatus 104. The number of channels of the dimmer preferably corresponds to the number of different colors in the luminous module 101.

By means of the control apparatus 104, it is possible, for example, for the correlated color temperature CCT of the light generated by the illumination device to be set essentially in a continuously variable manner within a predetermined range of the correlated color temperature CCT, for example from 2000 to 7000 kelvins. For this purpose, the control apparatus 104 may have at least one potentiometer, for example.

The invention is not restricted by the description on the basis of the exemplary embodiments. Rather, the invention encompasses any new feature and also any combination of features, which in particular comprises any combination of features in the patent claims, even if this feature or this combination itself is not explicitly specified in the patent claims or exemplary embodiments.

I claim:

1. An illumination device, comprising:

a first light-emitting diode module comprising at least one light-emitting diode that emits light in the red spectral range, at least one light-emitting diode that emits light in the green spectral range, and at least one light-emitting diode that emits light in the blue spectral range;

a second light-emitting diode module comprising at least one light-emitting diode that emits light in the yellow spectral range;

an apparatus configured to generate pulse-width-modulated signals for driving at least one portion of the light-emitting diodes; and a control apparatus configured to set at least one predefined correlated color temperature (CCT) of the light emitted by the illumination device.

2. The illumination device as claimed in claim 1, wherein the control apparatus comprises switches, and wherein each switch is assigned a color temperature of the white light emitted by the illumination device in such a way that as a result of one of the switches being closed and the remaining switches being opened, white light having the color temperature assigned to the switch is emitted by the illumination device.

3. The illumination device as claimed in claim 1, wherein the control apparatus comprises a network of three times eight series circuits, each series circuit including a potentiometer and a diode connected in series with the potentiometer.

4. The illumination device as claimed in claim 1, wherein depending on the state of the switches of the control apparatus, voltages are present at control inputs of the apparatus and the brightness of at least one portion of the light-emitting diodes of the light-emitting diode modules is dependent on said voltages.

5. The illumination device as claimed in claim 4, wherein the apparatus is configured to generate pulse-width-modulated signals for the blue, yellow, and red light-emitting diodes of the light-emitting diode module and the green light-emitting diodes emit light with maximum intensity independently of the position of the switches of the control apparatus.

6. The illumination device as claimed in claim 4, wherein the green light-emitting diodes of the first light-emitting diode module are directly connected to the current supply.

7. The illumination device as claimed in claim 1, wherein the control apparatus is configured to select at least between the following correlated color temperatures (CCT): 6500 K, 5500 K, 5000 K, 4100 K, 3500 K, 3000 K, 2800 K, 2500 K.

8. The illumination device as claimed in claim 1, wherein each light-emitting diode module comprises ten or fewer light-emitting diodes of the same color.

9. The illumination device as claimed in claim 1, wherein the first light-emitting diode module comprises at least one light-emitting diode that emits light with a central wavelength of between 455 nm and 485 nm, at least one light-emitting diode that emits light with a central wavelength of between 512 nm and 538 nm, and at least one light-emitting diode that emits light with a central wavelength of between 608 nm and 626 nm, and wherein the second light-emitting diode module comprises at least one light-emitting diode that emits light with a central wavelength between 580 nm and 594 nm.

* * * * *

UNITED STATES PATENT AND TRADEMARK OFFICE

CERTIFICATE OF CORRECTION

PATENT NO. : 7,334,917 B2
APPLICATION NO. : 11/238247
DATED : February 26, 2008
INVENTOR(S) : Joseph John Laski It is certified that error appears in the above-identified patent and that said Letters Patent is hereby corrected as shown below:

On the Title Page, Item (56) should read:

-- (56) References Cited

U.S. PATENT DOCUMENTS

~~6,488,390 B1* 12/2002 Lebens et al. 362/231~~

6,095,661* 08/2000 Lebens et al. 362/184

~~6,955,355 B2* 10/2005 Denoual 273/290~~

6,995,355 B2* 02/2006 Rains, Jr. et al. 250/228 --

Signed and Sealed this
Second Day of July, 2013

Teresa Stanek Rea
*Acting Director of the United States Patent and Trademark Office*